US005985791A

United States Patent [19]

Okada

[11] Patent Number: 5,985,791

[45] Date of Patent: Nov. 16, 1999

[54] THERMOSENSITIVE RECORDING MEDIUM

[75] Inventor: Shinji Okada, Shizuoka, Japan

[73] Assignee: Ricoh Company, Ltd, Tokyo, Japan

[21] Appl. No.: 09/088,921

[22] Filed: Jun. 2, 1998

[30] Foreign Application Priority Data

Jun. 3, 1997 [JP] Japan ..... 9-159283
Jun. 2, 1998 [JP] Japan ..... 10-167810

[51] Int. Cl.[6] ..... B41M 5/30

[52] U.S. Cl. ..... 503/208; 503/209; 503/214; 503/226

[58] Field of Search ..... 503/208, 209, 503/214, 226; 427/150–152

[56] References Cited

U.S. PATENT DOCUMENTS 5,866,504 2/1999 Okada et al. ..... 503/200

*Primary Examiner*—Bruce H. Hess
*Attorney, Agent, or Firm*—Cooper & Dunham LLP

[57] ABSTRACT

A thermosensitive recording medium has a support, and thermosensitive recording layer formed thereon containing an electron-donating coloring compound, an electron-accepting compound, a binder resin, a liquid resin which is in a liquid state at room temperature, and a plasticizer.

7 Claims, No Drawings

THERMOSENSITIVE RECORDING MEDIUM

BACKGROUND OF THE INVENTION

1. Field of the Invention

The present invention relates to a thermosensitive recording medium which utilizes a coloring reaction between an electron-donating coloring compound and an electron-accepting compound, and more particularly to a transparent thermosensitive recording medium which can be used as an image formation film for use with an overhead projector (OHP); an image formation film for use in the system of computer aided design (CAD); a film of a block copy, that is, an image formation film for gravure printing, offset printing, flexography and screen process printing; and a block copy film for textile printing.

2. Discussion of Background

There is widely known a thermosensitive recording medium which utilizes the coloring reaction between an electron-donating coloring compound (hereinafter referred to as a coloring agent) and an electron-accepting compound (hereinafter referred to as a color developer).

The application of the thermosensitive recording medium has expanded in recent years, and there is a demand for a transparent thermosensitive recording medium as an image formation film for the OHP, a second original for diazo copying, and a design drawing, and in addition, as a block copy film for gravure printing, offset printing and screen process printing.

For the above-mentioned applications, it is required that recording can be directly made on a thermosensitive recording medium by a thermal head. Such a thermosensitive recording medium is proposed in Japanese Laid-Open Patent Applications 61-121875 and 1-99873.

However, these thermosensitive recording media have the shortcomings that for the production thereof, there are required complicated steps such as microcapsulizing a coloring agent, dissolving a color developer in an organic solvent that is insoluble or slightly soluble in water, emulsifying the coloring agent in the form of microcapsules in the solution of the color developer to prepare a coating liquid for a thermosensitive recording layer, and coating the thus prepared coating emulsion dispersion on a transparent support. Further, the transparency of the recording media is not sufficient for use in practice. Therefore, when such conventional transparent thermosensitive recording medium is used as the block copy for printing, it is difficult to check the images formed on a plurality of block copies successively put one after the other because of insufficient transparency of each recording medium.

There is proposed in Japanese Laid-Open Patent Application 5-104859 a transparent thermosensitive recording medium which is excellent in transparency, and free from the above-mentioned problem with respect to the complicated producing method. According to this application, the first thing is to choose a solvent in which an organic acid to be employed as the color developer is slightly soluble or insoluble, and a coloring agent and a binder resin to be employed are soluble. A dispersion prepared by finely dispersing the organic acid serving as the color developer in the above-mentioned solvent, and a solution prepared by dissolving the coloring agent and the binder resin in the above-mentioned solvent are mixed and stirred, so that a coating liquid for a thermosensitive recording layer is obtained. The coating liquid thus obtained is coated on a transparent support, thereby obtaining a thermosensitive regarding layer. Then, a protective layer mainly comprising a resin is provided on the thermosensitive recording layer in order to fill up the minute surface roughness of the thermosensitive recording layer. By this method, a thermosensitive recording medium with high transparency can be obtained.

In recent years, however, in line with the trend toward high speed recording and economy of electric power, it is required to carry out thermal printing with the application of a low energy in light of the durability of a thermal head. In view of such a requirement, there is an increasing demand for a thermosensitive recording medium with high thermal sensitivity.

In Japanese Laid-Open Patent Application 8-175011, special attention is paid to the amount of solvent remaining in the thermosensitive recording layer of the obtained thermosensitive recording medium. According to this application, a thermosensitive recording sheet is produced in such a manner that one side or both sides of a base paper are coated with a coating liquid prepare by dissolving a resin in an organic solvent and the coating liquid is dried to prepare at least one resin layer on the base paper, and then a thermosensitive recording layer comprising a leuco dye and a color developer is provided on the above-prepared resin layer. It is reported that the fogging of background of the obtained thermosensitive recording sheet can be minimized during the storage by controlling the amount of organic solvent remaining in the thermosensitive recording sheet to 0.3 $g/m^2$ or less, and therefore, the thermosensitive recording sheet can be used as a second original for diazo copying. The art disclosed in this application, however, does not aim to improve the thermal sensitivity of thermosensitive recording medium.

The addition of a plasticizer to the thermosensitive recording layer is proposed in Japanese Laid-Open Patent Application 9-216466, and the addition of an ultraviolet-curing resin thereto is proposed in Japanese Laid-open Patent Application 9-254553. When the plasticizer is singly added to the recording layer, there occurs migration in the recording layer, so that the blocking resistance of the thermosensitive recording medium is lowered. On the other hand, when only a liquid resin such as the ultraviolet-curing resin is added to the composition of the recording layer, the thermal sensitivity cannot be stably maintained.

SUMMARY OF THE INVENTION

Accordingly, it is a first object of the present invention to provide a thermosensitive recording medium with high thermal sensitivity which does not deteriorate with time.

A second object of the present invention is to provide a thermosensitive recording medium with high blocking resistance.

The above-mentioned objects of the present invention can be achieved by a thermosensitive recording medium comprising a support, and thermosensitive recording layer formed thereon comprising an electron-donating coloring compound, an electron-accepting compound, a binder resin, a liquid resin which is in a liquid state at room temperature, and a plasticizer.

DESCRIPTION OF THE PREFERRED EMBODIMENTS

The thermosensitive recording medium is generally produced by coating method using an organic solvent in light of the properties of the recording medium. To inhibit the occurrence of coloring reaction during the preparation of the thermosensitive recording medium, drying operation cannot be performed at high temperature, so that a low-boiling organic solvent is employed for coating. In the case where the drying operation is carried out at a temperature lower than the boiling point of the employed low-boiling solvent, a small amount of low-boiling solvent remains in the obtained thermosensitive recording medium even though the drying period of time is extended.

It is confirmed that the low-boiling solvent remaining in the thermosensitive recording layer has an effect on the increase of thermal sensitivity of the recording medium. However, the organic solvent remaining in the recording layer is evaporating with time, and therefore, the thermal sensitivity of the recording medium deteriorates with time.

The inventors of the present invention have intensively learned about the means for improving the thermal sensitivity of the thermosensitive recording medium and maintaining such high thermal sensitivity regardless of passage of time. Namely, a proper material that can soften the recording layer or lower the melting point of the electron-accepting compound (color developer), and does not easily evaporate has been sought. As a result, when the thermosensitive recording layer comprises a plasticizer and a liquid resin which is in a liquid state at room temperature, has a high boiling point and does not easily evaporate, the softening point of a binder resin for use in the recording layer is lowered or the melting point of the electron-accepting compound is lowered. Therefore, the coloring initiation temperature can be lowered, which means the improvement of thermal sensitivity. Further, the thermal sensitivity can also be enhanced because the thermal conductivity can be improved due to the presence of a liquid resin in the recording layer.

Specific examples of the plasticizer for use in the thermosensitive recording layer are phthalic acid esters such as octyldecyl phthalate, dimethyl phthalate, diethyl phthalate, diheptyl phthalate, 2-ethylhexyl phthalate, diisononyl phthalate, diisodecyl phthalate, and butylbenzyl phthalate; phosphoric esters such as tributyl phosphate, tri-2-ethylhexyl phosphate, triphenyl phosphate, and tricresyl phosphate; aliphatic monobasic esters such as butyl oleate and glycerin monooleic acid ester; aliphatic dibasic esters such as dibutyl adipate, di-n-hexyl adipate, di-2-ethylhexyl adipate, dibutyl sebacate, and 2-ethylhexyl sebacate; dihydric alcohol esters such as diethylene glycol dibenzoate and triethylene glycol di-2-ethyl butyrate; hydroxy acid esters such as methyl acetylcinoleate, butyl acetylricinoleate, butyl phthalylbutyl glycolate, and tributyl acetylcitrate; chlorinated paraffin; chlorinated biphenyl-2-nitrobiphenyl; dinonyl naphthalene; o-toluenesulfonethylamide and p-toluenesulfonethylamide; camphor; and methyl abietate. Of those plasticizers, a plasticizer which is highly compatible with the binder resin contained in the thermosensitive recording layer may be selected.

Those plasticizers may be used alone or in combination.

Any methods are usable for the addition of the plasticizer to the thermosensitive recording layer so long as the above-mentioned plasticizer may be contained in the thermosensitive recording layer. For instance, the plasticizer may be directly contained in the thermosensitive recording layer. Alternatively, the plasticizer may be added to the composition of an overcoat layer such as a protective layer which is overlaid on the thermosensitive recording layer so as to impregnate the recording layer with the plasticizer when the overcoat layer coating liquid is coated on the thermosensitive recording layer.

Specific examples of the liquid resin for use in the thermosensitive recording layer include ultraviolet-curing resins such as urethane acrylate, ester acrylate and epoxy acrylate, electron-beam curing resins, liquid polybutadiene, liquid butadiene rubber, liquid styrene-butadiene rubber, liquid nitrile butadiene rubber, liquid chloroprene rubber, liquid polyisoprene, liquid polysulfide, liquid polyisobutylene, liquid butyl rubber, liquid phenolic resin, liquid epoxy resin and liquid xylene resin. Of those liquid resins, a liquid resin highly compatible with the binder resin for use in the thermosensitive recording layer may be selected. Those liquid resins may be used alone or in combination.

The above-mentioned ultraviolet-curing resin is prepared by polymerizing a monomer such as isocyanurate, oligomer or prepolymer which is polymerizable to form a cured resin by the application of ultraviolet light thereto. There are no limitations on such a monomer, oligomer or prepolymer for the preparation of the ultraviolet-curing resin, and conventional monomers, oligomers and prepolymers can be employed.

There are no particular limitations on the electron-beam curing resins used as the liquid resins in the thermosensitive recording layer. A particularly preferable electron-beam curing resin for use in the present invention is an electron-beam curing resin comprising a polyester skeleton with a five or more functional branched molecular structure.

Any methods are usable so long as the above-mentioned liquid resin may be contained in the thermosensitive recording layer. For instance, the liquid resin may be directly contained in the thermosensitive recording layer. Alternatively, the liquid resin may be added to the composition of an overcoat layer such as a protective layer which is overlaid on the thermosensitive recording layer so as to impregnate the recording layer with the liquid resin when the overcoat layer coating liquid is coated on the recording layer.

It is preferable that the amount ratio by weight of the plasticizer be in the range of 0.1 to 95 wt. %, more preferably in the range of 1 to 90 wt. %, of the total weight of a mixture of the plasticizer and the liquid resin.

Further, it is preferable that the amount ratio by weight of the mixture of the plasticizer and the liquid resin be in the range of 0.1 to 20 wt. % of the total weight of the thermosensitive recording layer.

When the amount ratio of the mixture of the plasticizer and the liquid resin is within the above-mentioned range, high thermal sensitivity can be maintained and the blocking resistance of the obtained recording medium can be improved.

In addition to the previously mentioned plasticizer and liquid resin, (1) a high-boiling organic solvent, (2) fats and oils, and other additives, and (3) a surfactant may be contained in the thermosensitive recording layer in order to minimize the change of thermal sensitivity.

Examples of the high-boiling organic solvent for use in the thermosensitive recording layer include hydrocarbons such as isopropylbenzene, diethylbenzene, sec-butylbenzene, triethylbenzene, polyethylbenzene, diisopropylbenzene and alumina naphthalene; mixed high-boiling aromatic solvents such as tetrahydronaphthalene, decahydronaphthalene, terpene, pine tar, diterpene such as limonene, solvent naphtha, light solvent naphtha, flammable naphtha, heavy solvent naphtha, and aromatic petroleum naphtha; hydrocarbon chloride such as dichloropentane, dichlorohydrine, dichloroethyl ether, dichloroisopropyl ether, dichloroethyl formal, triglycol dichloride, monochlorobenzene, trichlorobenzene, and o-dichlorobenzene; alcohols such as 3-methoxydibutyl alcohol, secondary heptyl alcohol, n-octyl alcohol, n-decanol, secondary undecyl alcohol, trimethyl nonylalcohol, secondary tetradecyl alcohol, phenol, cyclohexanol, methycyclohexanol, 3,3,5-trimethylcyclohexanol, benzyl alcohol, phenyl methyl carbinol, diacetone alcohol, o-cresole, m-cresol, and p-cresol; ketones such as methyl n-amyl ketone, cyclohexanone, m-methylcyclohexanone, p-cyclohexanone, isophorone, 2,4-pentanedione, acetonylacetone, diacetone alcohol, acetophenone, and dypnone; ethers such as hexyl ether, 2-ethylhexyl ether, ethylene glycol mono-n-hexyl ether, ethylene glycol monophenyl ether, ethylene glycol mono-2-ethylbutyl ether, ethylene glycol dibutyl ether, diethylene glycol monoethyl ether, diethylene glycol diethyl ether, diethylene glycol monobutyl ether, diethylene glycol dibutyl ether, diethylene glycol mono-n-hexyl ether, ethoxy triglycol, tetraethylene glycol dibutyl ether, dipropylene glycol methyl ether, tripropylene glycol methyl ether, terpene methyl ether, and terpene glycol; and esters such as glycol diformate, γ-valerolactone, 2-ethylbutyl acetate, benzyl acetate, cyclohexyl acetate, methyl cyclohexyl acetate, nonyl acetate, methyl acetoacetate, ethyl acetoacetate, ethylene glycol acetate monoethyl ether, diethylene glycol acetate monomethyl acetate, diethylene glycol acetate monoethyl ether, diethylene glycol acetate monobutyl ether, glycol diacetate, methoxy acetate triglycol, butyl butyrate, isoamyl butyrate, ethyl lactate, butyl lactate, diethyl oxalate, dibutyl oxalate, dimethyl maleate, diethyl maleate, dimethyl fumarate, tributyl borate, monoacetin, diacetin, and triacetin. Of these solvents, a solvent highly compatible with the binder resin for use in the thermosensitive recording layer may be selected. Those solvents may be used alone or in combination.

Examples of the fats and oils for use in the thermosensitive recording layer are soybean oil, linseed oil, cotton seed oil, rapeseed oil, tung oil, castor oil, oleic acid, isostearyl alcohol, isostearic acid, dimer acid, glycerin, diglycerin, and polyglycerin. Furthermore, additives such as a silane coupling agent and a silicone oil can be added to the recording layer.

With respect to the surfactant for use in the thermosensitive recording layer, oil-soluble surfactants are preferable. Specific examples of the surfactants include anionic surfactants of carboxylic acid type, sulfate type, sulfonic acid type, and phosphate type; cationic surfactants of higher amine type and higher alkyl quaternary ammonium salt type; amphoteric surfactants of carboxylic acid type, sulfate type, sulfonic acid type, and phosphate type; and nonionic surfactants of perfluoro alcohol type, polyethylene glycol type, and polyhydroxy alcohol fatty acid ester type. Those surfactants may be used alone or in combination.

It is preferable to employ a surfactant which is soluble in an organic solvent and compatible with the binder resin for use in the thermosensitive recording layer, and has a HLB value of 4 or less.

The thermosensitive recording layer comprises an electron-donating compound as a coloring agent. The coloring agent for use in the present invention is a colorless or light-colored dye precursor and is not limited to particular compounds, but conventional coloring agents such as triphenylmethane phthalide leuco compounds, triallylmethane leuco compounds, fluoran leuco compounds, phenothiazine leuco compounds, thiofluoran leuco compounds, xanthene leuco compounds, indophthalyl leuco compounds, spiropyran leuco compounds, azaphtalide leuco compounds, couromenopyrazole leuco compounds, methine leuco compounds, rhodamineanilinolactam leuco compounds, rhodaminelactam leuco compounds, quinazoline leuco compounds, diazaxanthene leuco compounds, and bislactone leuco compounds are preferably employed.

Specific examples of those leuco dyes are as follows:

2-anilino-3-methyl-6-diethylaminofluoran,
2-anilino-3-methyl-6-(di-n-butylamino)fluoran,
2-anilino-3-methyl-6-(N-n-propyl-N-methylamino)fluoran,
2-anilino-3-methyl-6-(N-isopropyl-N-methylamino)fluoran,
2-anilino-3-methyl-6-(N-isobutyl-N-methylamino)fluoran,
2-anilino-3-methyl-6-(N-n-amyl-N-methylamino)fluoran,
2-anilino-3-methyl-6-(N-sec-butyl-N-ethylamino)fluoran,
2-anilino-3-methyl-6-(N-n-amyl-N-ethylamino)fluoran,
2-anilino-3-methyl-6-(N-isoamyl-N-ethylamino)fluoran,
2-anilino-3-methyl-6-(N-n-propyl-N-isopropylamino) fluoran,
2-anilino-3-methyl-6-(N-cyclohexyl-N-methylamino) fluoran,
2-anilino-3-methyl-6-(N-ethyl-p-toluidino)fluoran,
2-anilino-3-methyl-6-(N-methyl-p-toluidino)fluoran,
2-(m-trichloromethylanilino)-3-methyl-6-diethylaminofluoran,
2-(m-trichloromethylanilino)-3-methyl-6-(N-cyclohexyl-N-methylamino)fluoran,
2-(2,4-dimethylanilino)-3-methyl-6-diethylaminofluoran,
2-(N-ethyl-p-toluidino)-3-methyl-6-(N-ethylanilino) fluoran,
2-(N-methyl-p-toluidino)-3-methyl-6-(N-propyl-p-toluidino)fluoran,
2-anilino-6-(N-n-hexyl-N-ethylamino)fluoran,
2-(o-chloroanilino)-6-diethylaminofluoran,
2-(o-bromoanilino)-6-diethylaminofluoran,
2-(o-chloroanilino)-6-dibutylaminofluoran,
2-(o-fluoroanilino)-6-dibutylaminofluoran,
2-(m-trifluoromethylanilino)-6-diethylaminofluoran,
2-(p-acetylanilino)-6-(N-n-amyl-N-n-butylamino)fluoran,
2-benzylamino-6-(N-ethyl-p-toluidino)fluoran,
2-benzylamino-6-(N-methyl-2,4-dimethylanilino)fluoran,
2-benzylamino-6-(N-ethyl-2,4-dimethylanilino)fluoran,
2-dibenzylamino-6-(N-methyl-p-toluidino)fluoran,
2-dibenzylamino-6-(N-ethyl-p-toluidino)fluoran,
2-(di-p-methylbenzylamino)-6-(N-ethyl-p-toluidino) fluoran,
2-(α-phenylethylamino)-6-(N-ethyl-p-toluidino)fluoran,
2-methylamino-6-(N-methylanilino)fluoran,
2-methylamino-6-(N-ethylanilino)fluoran,
2-methylamino-6-(N-propylanilino)fluoran,
2-ethylamino-6-(N-methyl-p-toluidino)fluoran,
2-methylamino-6-(N-methyl-2,4-dimethylanilino)fluoran,
2-ethylamino-6-(N-methyl-2,4-dimethylanilino)fluoran,
2-dimethylamino-6-(N-methylanilino)fluoran,
2-dimethylamino-6-(N-ethylanilino)fluoran,
2-diethylamino-6-(N-methyl-p-toluidino)fluoran,
2-diethylamino-6-(N-ethyl-p-toluidino)fluoran,
2-dipropylamino-6-(N-methylanilino)fluoran,
2-dipropylamino-6-(N-ethylanilino)fluoran,
2-amino-6-(N-methylanilino)fluoran,
2-amino-6-(N-ethylanilino)fluoran,
2-amino-6-(N-propylanilino)fluoran,
2-amino-6-(N-methyl-p-toluidino)fluoran,
2-amino-6-(N-ethyl-p-toluidino)fluoran,
2-amino-6-(N-propyl-p-toluidino)fluoran,
2-amino-6-(N-methyl-p-ethylanilino)fluoran,
2-amino-6-(N-ethyl-p-ethylanilino)fluoran, 2-amino-6-(N-propyl-p-ethylanilino)fluoran,
2-amino-6-(N-methyl-2,4-dimethylanilino)fluoran,
2-amino-6-(N-ethyl-2,4-dimethylanilino)fluoran,
2-amino-6-(N-propyl-2,4-dimethylanilino)fluoran,
2-amino-6-(N-methyl-p-chloroanilino)fluoran,
2-amino-6-(N-ethyl-p-chloroanilino)fluoran,
2-amino-6-(N-propyl-p-chloroanilino)fluoran,
2,3-dimethyl-6-dimethylaminofluoran,
3-methyl-6-(N-ethyl-p-toluidino)fluoran,
2-chloro-6-diethylaminofluoran,
2-bromo-6-diethylaminofluoran,
2-chloro-6-dipropylaminofluoran,
3-chloro-6-cyclohexylaminofluoran,
3-bromo-6-cyclohexylaminofluoran,
2-chloro-6-(N-ethyl-N-isoamylamino)fluoran,
2-chloro-3-methyl-6-diethylaminofluoran,
2-anilino-3-chloro-6-diethylaminofluoran,
2-(o-chloroanilino)-3-chloro-6-cyclohexylaminofluoran,
2-(m-trifluoromethylanilino)-3-chloro-6-diethylaminofluoran,
2-(2,3-dichloroanilino)-3-chloro-6-diethylaminofluoran,
1,2-benzo-6-diethylaminofluoran,
1,2-benzo-6-(N-ethyl-N-isoamylamino)fluoran,
1,2-benzo-6-dibutylaminofluoran,
1,2-benzo-6-(N-ethyl-N-cyclohexylamino)fluoran, and
1,2-benzo-6-(N-ethyl-toluidino)fluoran.

The following coloring agents can also be preferably employed in the present invention:

2-anilino-3-methyl-6-(N-2-ethoxypropyl-N-ethylamino) fluoran,
2-(p-chloroanilino)-6-(N-n-octylamino)fluoran,
2-(p-chloroanilino)-6-(N-n-palmitylamino)fluoran,
2-(p-chloroanilino)-6-(di-n-octylamino)fluoran,
2-benzoylamino-6-(N-ethyl-p-toluidino)fluoran,
2-(o-methoxybenzoylamino)-6-(N-ethyl-p-toluidino) fluoran,
2-dibenzylamino-4-methyl-6-diethylaminofluoran,
2-dibenzylamino-4-methoxy-6-(N-ethyl-p-toluidino) fluoran,
2-dibenzylamino-4-methyl-6-(N-ethyl-p-toluidino)fluoran,
2-(α-phenylethylamino)-4-methyl-6-diethylaminofluoran,
2-(p-toluidino)-3-(t-butyl)-6-(N-methyl-p-toluidino)fluoran,
2-(o-methoxycarbonylanilino)-6-diethylaminofluoran,
2-acetylamino-6-(N-methyl-p-toluidino)fluoran,
3-diethylamino-6-(m-trifluoromethylanilino)fluoran,
4-methoxy-6-(N-ethyl-p-toluidino)fluoran,
2-ethoxyethylamino-3-chloro-6-dibutylaminofluoran,
2-dibenzylamino-4-chloro-6-(N-ethyl-p-toluidino)fluoran,
2-(α-phenylethylamino)-4-chloro-6-diethylaminofluoran,
2-(N-benzyl-p-trifluoromethylanilino)-4-chloro-6-diethylaminofluoran,
2-anilino-3-methyl-6-pyrrolidinofluoran,
2-anilino-3-chloro-6-pyrrolidinofluoran,
2-anilino-3-methyl-6-(N-ethyl-N-tetrahydrofurfurylamino) fluoran,
2-mesidino-4',5'-benzo-6-diethylaminofluoran,
2-(m-trifluoromethylanilino)-3-methyl-6-pyrrolidinofluoran,
2-(α-naphthylamino)-3,4-benzo-4'-bromo-6-(N-benzyl-N-cyclohexylamino)fluoran,
2-piperidino-6-diethylaminofluoran,
2-(N-n-propyl-p-trifluoromethylanilino)-6-morpholinofluoran,
2-(di-N-p-chlorophenyl-methylamino)-6-pyrrolidinofluoran,
2-(N-n-propyl-m-trifluoromethylanilino)-6-morpholinofluoran,
1,2-benzo-6-(N-ethyl-N-n-octylamino)fluoran,
1,2-benzo-6-diallylaminofluoran,
1,2-benzo-6-(N-ethoxyethyl-N-ethylamino)fluoran,
benzo leuco methylene blue,
2-[3,6-bis(diethylamino)]-6-(o-chloroanilino) xanthylbenzoic acid lactam,
2-[3,6-bis(diethylamino)]-9-(o-chloroanilino) xanthylbenzoic acid lactam,
3,3-bis(p-dimethylaminophenyl)phthalide,
3,3-bis(p-dimethylaminophenyl)-6-dimethylaminophthalide (or Crystal Violet Lactone),
3,3-bis(p-dimethylaminophenyl)-6-diethylaminophthalide,
3,3-bis(p-dimethylaminophenyl)-6-chlorophthalide,
3,3-bis(p-dibutylaminophenyl)phthalide,
3-(2-methoxy-4-dimethylaminophenyl)-3-(2-hydroxy-4,5-dichlorophenyl)phthalide,
3-(2-hydroxy-4-dimethylaminophenyl)-3-(2-methoxy-5-chlorophenyl)phthalide,
3-(2-hydroxy-4-dimethoxyaminophenyl)-3-(2-methoxy-5-chlorophenyl)phthalide,
3-(2-hydroxy-4-dimethylaminophenyl)-3-(2-methoxy-5-nitrophenyl)phthalide,
3-(2-hydroxy-4-diethylaminophenyl)-3-(2-methoxy-5-methylphenyl)phthalide,
3,6-bis(dimethylamino)fluorenespiro(9,3')-6'-dimethylaminophthalide,
6'-chloro-8'-methoxy-benzoindolino-spiropyran, and
6'-bromo-2'-methoxy-benzoindolino-spiropyran.

Those coloring agents may be used alone or in combination.

The color developer for use in the thermosensitive recording layer is an electron-accepting compound capable of inducing color formation in the above-mentioned coloring agents. A variety of conventional electron-accepting color developers can be employed in the present invention. Reversible or nonreversible electron-accepting compounds are available. In particular, an electron-accepting color developer having a long-chain alkyl group in its molecule as stated in Japanese Patent Application 3-355078 is preferably used as the color developer in the present invention. For example, there are disclosed an organic phosphoric acid compound, an aliphatic carboxylic acid compound and a phenolic compound, each having an aliphatic group with 12 or more carbon atoms; a metallic salt of mercaptoacetic acid having an aliphatic group with 10 to 18 carbon atoms; an alkylester of caffeic acid having an alkyl group with 5 to 8 carbon atoms; and an acid phosphate having an aliphatic group with 16 or more carbon atoms. The above-mentioned aliphatic group includes a straight-chain or branched alkyl group or alkenyl group, which may have a substituent such as a halogen atom, an alkoxyl group, or an ester group.

In the present invention, the following organic phosphoric acid compounds represented by formulas (1) and (2) are preferably employed as the color developers:

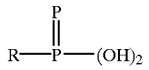

(1)

wherein R is a straight-chain alkyl group having 16 to 24 carbon atoms.

(2)

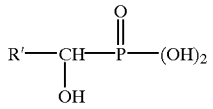

wherein R' is a straight-chain alkyl group having 13 to 23 carbon atoms.

The aforementioned color developers may be used alone or in combination.

With respect to the amount ratio of the color developer to the coloring agent, it is preferable that one to 20 parts by weight, more preferably 2 to 10 parts by weight, of the color developer be used in combination with one part by weight of the coloring agent.

The thermosensitive recording layer comprises a binder resin. Any conventional resins, in particular, resins having hydroxyl group or carboxyl group in the molecule thereof are preferably employed. Examples of such binder resins for use in the thermosensitive recording layer are polyvinyl acetal resins such as polyvinyl butyral and polyvinyl acetoacetal; cellulose derivatives such as ethyl cellulose, cellulose acetate propionate and cellulose acetate butyrate; and epoxy resin. Those resins can be used alone or in combination.

To obtain the thermosensitive recording layer, a coating liquid for the thermosensitive recording layer is prepared by uniformly dispersing or dissolving a coloring agent, a color developer, a binder resin, a plasticizer and a liquid resin in an organic solvent. Then, the coating liquid thus prepared is coated on a support and dried. The coating method is not particularly limited. It is preferable that the particle size of the particles dispersed in the coating liquid be 10 $\mu$m or less, more preferably 5 $\mu$m or less, and further preferably 1 $\mu$m or less.

The thickness of the thus obtained thermosensitive recording layer, which varies depending on the formulation for the thermosensitive recording layer or the application of the obtained thermosensitive recording medium, is preferably in the range of about 1 to 50 $\mu$m, more preferably in the range of 3 to 20 $\mu$m.

For the purpose of improving the coating properties and the recording characteristics, the coating liquid for the thermosensitive recording layer may further comprise a variety of additives which are employed in the conventional thermosensitive recording papers.

Some additives conventionally employed in this kind of thermosensitive recording medium, for example, a filler, a surfactant, a lubricant and an agent inhibiting the coloring reaction due to pressure application may be optionally added to the formulation for the recording layer so long as the transparency of the obtained recording medium is not impaired when a transparent thermosensitive recording medium is prepared.

Specific examples of the filler for use in the thermosensitive recording layer are finely-divided particles of an inorganic filler such as calcium carbonate, silica, zinc oxide, titanium oxide, aluminum hydroxide, zinc hydroxide, barium sulfate, clay, kaolin, talc, and surface-treated calcium carbonate and silica; and finely-divided particles of an organic filler such as urea-formalin resin, styrene-methacrylic acid copolymer, polystyrene resin and vinylidene chloride resin.

Specific examples of the lubricant for use in the thermosensitive recording layer are higher fatty acids and metallic salts thereof, higher fatty acid amides, higher fatty acid esters, and waxes such as animal wax, vegetable wax, mineral wax and petroleum wax.

A colored image can be formed in the thermosensitive recording medium of the present invention by the application of heat thereto using a thermal head, thermal pen or laser beam. The heat application means is not particularly limited, and may be selected according to the application of the recording medium.

For the support for use in the thermosensitive recording medium according to the present invention, there can be generally employed a sheet of synthetic paper and high quality paper. When a transparent support is used, a film made of a polyester resin such as polyethylene terephthalate or polybutylene terephthalate; a film made of a cellulose derivative such as cellulose triacetate; a film made of a polyolefin resin such as polypropylene or polyethylene; and a film of polystyrene are usable. Further, those films may be laminated to prepare a transparent support of the thermosensitive recording medium.

The thermosensitive recording medium of the present invention may further comprise a protective layer which is overlaid on the thermosensitive recording layer in order to improve the image quality of the obtained images and the preservation stability of the recording medium. In particular, the protective layer may be provided on the thermosensitive recording layer in light of the transparency, chemical resistance, water resistance, abrasion resistance and light resistance of the obtained thermosensitive recording medium, and matching properties thereof with the thermal head.

The protective layer for use in the present invention may be a film which mainly comprises a water-soluble resin or a hydrophobic resin, or a film which mainly comprises an ultraviolet-curing resin or an electron-beam curing resin.

Specific examples of the water-soluble resin for use in the protective layer include polyvinyl alcohol, modified polyvinyl alcohol, cellulose derivatives such as methyl cellulose, ethoxy cellulose and hydroxy cellulose, casein, gelatin, polyvinyl pyrrolidone, styrene-maleic anhydride copolymer, diisobutylene-maleic anhydride copolymer, polyacrylamide, modified polyacrylamide, methyl vinyl ether-maleic anhydride copolymer, carboxy-modified polyethylene, polyvinyl alcohol-acrylamide block copolymer, melamine-formaldehyde resin, and urea-formaldehyde resin.

Specific examples of the resin for aqueous emulsion or the hydrophobic resin for use in the protective layer include polyvinyl acetate, polyurethane, styrene-butadiene copolymer, styrene-butadiene-acryl copolymer, polyacrylic acid, polyacrylic ester, vinyl chloride-vinyl acetate copolymer, polybutyl methacrylate, polyvinyl butyral, polyvinyl acetal, ethyl cellulose, and ethylene-vinyl acetate copolymer. Further, a copolymer comprising the segments constituting the above-mentioned resins and a silicone segment can be preferably employed. These resins can be used alone or in combination. When necessary, a curing agent may be added to these resins to cure the resins.

The ultraviolet-curing resin for use in the protective layer is prepared by polymerizing a monomer, oligomer or prepolymer which is polymerizable to form a cured resin by the application of ultraviolet light thereto. There are no limitations on such a monomer, oligomer or prepolymer for the preparation of the ultraviolet-curing resin for use in the protective layer, and conventional monomers, oligomers and prepolymers can be employed.

There are no particular limitations on the electron-beam curing resins for use in the protective layer. Particularly preferable electron-beam curing resins for use in the protective layer are an electron-beam curing resin comprising a polyester skeleton with a five or more functional branched molecular structure and a resin comprising as the main component a silicone-modified electron-beam curing resin.

The head-matching performance of the thermosensitive recording medium of the present invention can be improved by adding an organic or inorganic filler and a lubricant to the protective layer to such an extent that the surface smoothness thereof is not impaired by the addition of such a filler and a lubricant.

In this case, it is preferable that the particle size of filler for use in the protective layer be 0.3 $\mu$m or less. Further, a pigment with an oil absorption of 30 ml/100 g or more, and more preferably 80 ml/100 g or more is preferably used as the filler. One or more inorganic and/or organic pigments that are conventionally employed in this kind of thermosensitive recording medium may be selected.

Specific examples of the filler for use in the protective layer include inorganic pigments such as calcium carbonate, silica, zinc oxide, titanium oxide, aluminum hydroxide, zinc hydroxide, barium sulfate, kaolin, talc, and surface-treated calcium carbonate and silica; and organic pigments such as urea-formalin resin, styrene-methacrylic acid copolymer and polystyrene resin.

The protective layer can be provided on the thermosensitive recording layer by the conventional coating method. It is preferable that the thickness of the protective layer be in the range of 0.1 to 20 $\mu$m, and more preferably in the range of 0.5 to 10 $\mu$m. When the thickness of the protective layer is within the above-mentioned range, the protective layer can work to protect the recording medium and improve the head-matching properties, without the decrease of thermal sensitivity of the obtained recording medium.

The thermosensitive recording medium of the present invention may further comprise an antistatic layer which is provided on the back side of the support, opposite to the thermosensitive recording layer with respect to the support, and on the protective layer.

The antistatic layer may comprise a surfactant or a electroconductive metallic oxide.

For the formation of the antistatic layer comprising a surfactant, anionic, cationic, nonionic and amphoteric surfactants can be employed. In particular, cationic or amphoteric surfactants are superior from the viewpoints of antistatic properties and durability. Such an antistatic layer of a surfactant type can be prepared at relatively low cost, and many kinds of surfactants are usable. However, the surfactant type antistatic layer is susceptible to humidity because this kind of antistatic layer becomes electroconductive due to adsorption of moisture content by the surfactant. Therefore, the antistatic properties of the antistatic layer tend to lower under the circumstances of low humidity.

On the other hand, the antistatic layer comprising an electroconductive metallic oxide is expensive and does not have so many varieties. However, since the metallic oxide itself has electroconductivity, the antistatic layer of an electroconductive metallic oxide type exhibits sufficient electroconductivity even with a small deposition amount, so that high transparency of the thermosensitive recording medium can be maintained. In addition, the antistatic properties are excellent under the circumstances of low humidity.

Examples of the electroconductive metallic oxide for use in the antistatic layer include metallic oxides such as $SnO_2$, $In_2O_3$, ZnO, $TiO_2$, MgO, $Al_2O_3$, BaO and $MoO_3$; and composite metallic oxides composed of the above-mentioned metallic oxides and metallic oxides of P, Sb, Sn and Zn.

The particles of the above-mentioned metallic oxide may be as fine as possible. The more fine particles of metallic oxide, the higher the transparency of the obtained recording medium. To be more specific, when the average particle diameter of the antistatic agent such as the metallic oxide is 0.2 $\mu$m or less, sufficient transparency can be obtained.

In the antistatic layer, the above-mentioned finely-divided particles of metallic oxide are used in combination with a binder agent such as a water-soluble resin, an aqueous emulsion, a hydrophobic resin, an ultraviolet-curing resin or an electron-beam curing resin.

Specific examples of the water-soluble resin for use in the antistatic layer include polyvinyl alcohol, cellulose derivative, casein, gelatin, styrene-maleic anhydride copolymer, and carboxy-modified polyethylene resin.

Specific examples of the resin for aqueous emulsion or the hydrophobic resin for use in the antistatic layer include polyvinyl acetate, polyurethane, vinyl chloride-vinyl acetate copolymer, polyester, polybutyl acrylate, polyvinyl butyral, polyvinyl acetal, and ethylene-vinyl acetate copolymer. These resins can be used alone or in combination. When necessary, a curing agent may be added to these resins to cure the resins.

The above-mentioned ultraviolet-curing resin for use in the antistatic layer is prepared by polymerizing a monomer, oligomer or prepolymer which is polymerizable to form a cured resin by the application of ultraviolet light thereto. There are no limitations on such a monomer, oligomer or prepolymer for the preparation of the ultraviolet-curing resin, and conventional monomers, oligomers and prepolymers can be employed.

There are no particular limitations on the electron-beam curing resins for use in the antistatic layer. A particularly preferable electron-beam curing resin for use in the antistatic layer is an electron-beam curing resin comprising a polyester skeleton with a five or more functional branched molecular structure.

In the antistatic layer of metallic oxide type, it is preferable that the amount of metallic oxide be in the range of about 0.05 to 2 parts by weight, and more preferably in the range of about 0.2 to 1.5 parts by weight, to one part by weight of the binder resin.

Other features of this invention will become apparent in the course of the following description of exemplary embodiments, which are given for illustration of the invention and are not intended to be limiting thereof.

EXAMPLE 1

A mixture of the following components was sufficiently dispersed and pulverized in a ball mill so as to have a particle size of 0.3 $\mu$m, whereby a coating liquid A for a thermosensitive recording layer was prepared:

Thermosensitive Recording Layer Coating Liquid A

| | Parts by Weight |
|---|---|
| 3-diethylamino-6-methyl-7-anilinofluoran | 4 |
| Octadecylphosphonic acid | 42 |
| Polyvinyl butyral "Denka Butyral #3000-2" (Trademark) made by Denki Kagaku Kogyo Kabushiki kaisha | 21 |
| Toluene | 200 |
| Methyl ethyl ketone | 200 |

-continued

| | Parts by Weight |
|---|---|
| Octyldecyl phthalate (Plasticizer) | 12 |
| Tris(acryloxyethyl)isocyanurate (Liquid resin) "Aronix -315" (Trademark) made by Toagosei Chemical Industry Co., Ltd | 12 |

The thus prepared thermosensitive recording layer coating liquid A was coated on a polyester film serving as a support using a wire bar, and dried at 60° C. for 3 minutes, whereby a thermosensitive recording layer with a thickness of 10 $\mu$m was formed on the support.

The following components were mixed to prepare a coating liquid B for a protective layer:

Protective Layer Coating Liquid B

| | Parts by Weight |
|---|---|
| Silicone-modified acrylic resin "US350" (Trademark) made by Toagosei Chemical Industry Co., Ltd. (solid content: 30%) | 35 |
| Methyl ethyl ketone | 50 |

The thus obtained protective layer coating liquid B was coated on the above-prepared thermosensitive recording layer using a wire bar, and dried at 60° C. for 3 minutes, whereby a protective layer with a thickness of 3 $\mu$m was provided on the thermosensitive recording layer.

Thus, a thermosensitive recording medium No. 1 according to the present invention was obtained.

COMPARATIVE EXAMPLE 1

The procedure for preparation of the thermosensitive recording medium No. 1 in Example 1 was repeated except that the thermosensitive recording layer coating liquid A used in Example 1 was changed to the following coating liquid C for a thermosensitive recording layer:

Thermosensitive Recording Layer Coating Liquid C

| | Parts by Weight |
|---|---|
| 3-diethylamino-6-methyl-7-anilinofluoran | 4 |
| Octadecylphosphonic acid | 12 |
| Polyvinyl butyral "Denka Butyral #3000-2" (Trademark) made by Denki Kagaku Kogyo Kabushiki kaisha | 6 |
| Toluene | 39 |
| Methyl ethyl ketone | 39 |

Thus, a comparative thermosensitive recording medium No. 1 was obtained.

COMPARATIVE EXAMPLE 2

The procedure for preparation of the thermosensitive recording medium No. 1 in Example 1 was repeated except that the thermosensitive recording layer coating liquid A used in Example 1 was changed to the following coating liquid D for a thermosensitive recording layer:

Thermosensitive Recording Layer Coating Liquid D

| | Parts by Weight |
|---|---|
| 3-diethylamino-6-methyl-7-anilinofluoran | 12 |
| Octadecylphosphonic acid | 36 |
| Polyvinyl butyral "Denka Butyral #3000-2" (Trademark) made by Denki Kagaku Kogyo Kabushiki kaisha | 18 |
| Toluene | 200 |
| Methyl ethyl ketone | 200 |
| Octyldecyl phthalate (Plasticizer) | 34 |

Thus, a comparative thermosensitive recording medium No. 2 was obtained.

EXAMPLE 2

The procedure for preparation of the thermosensitive recording medium No. 1 in Example 1 was repeated except that the thermosensitive recording layer coating liquid A used in Example 1 was changed to the following coating liquid E for a thermosensitive recording layer:

Thermosensitive Recording Layer Coating Liquid E

| | Parts by Weight |
|---|---|
| 3-diethylamino-6-methyl-7-anilinofluoran | 16 |
| Octadecylphosphonic acid | 48 |
| Polyvinyl butyral "Denka Butyral #3000-2" (Trademark) made by Denki Kagaku Kogyo Kabushiki kaisha | 24 |
| Toluene | 200 |
| Methyl ethyl ketone | 200 |
| Octyldecyl phthalate (Plasticizer) | 6 |
| Tris(acryloxyethyl)isocyanurate (Liquid resin) "Aronix-315" (Trademark) made by Toagosei Chemical Industry Co., Ltd. | 6 |

Thus, a thermosensitive recording medium No. 2 according to the present invention was obtained.

Each of the thermosensitive recording media No. 1 and No. 2 according to the present invention and the comparative thermosensitive recording media No. 1 and No. 2 was subjected to the following evaluation tests:

(1) Thermal Sensitivity

Immediately after preparation of each thermosensitive recording medium, the thermosensitive recording medium was subjected to thermal printing using a thermal printer equipped with a thermal head of a dot density of 8 dots/mm. With the application of electric power of 0.63 W/dot, an image sample was produced on the thermosensitive recording medium with the pulse width being changed from 0.3 to 1.2 ms (11.5 to 46.2 mJ/mm$^2$) by 0.1 ms. The image density of each image sample was measured using a transmission type densitometer "X-Rite 361" (Trademark), made by X-RITE Company, Ltd. The thermal sensitivity of the thermosensitive recording medium was expressed by a thermal energy which was applied to the thermosensitive recording medium so as to obtain the saturation image density.

Each thermosensitive recording medium in the form of a sheet was similarly subjected to thermal printing after allowed to stand at 50° C. for 200 hours. Thus, it was confirmed whether the thermal sensitivity of each recording medium deteriorated or not after stored at 50° C. for 200 hours.

The results are shown in TABLE 1.

(2) Blocking Resistance

Each thermosensitive recording medium was cut into two samples of 5 cm×5 cm. The one sample was overlaid on the other in such a fashion that the back side of the support of the one sample was in contact with the protective layer side of the other sample. With the application of a pressure of 3 kg/cm$^2$, the two samples were allowed to stand at 40° C. under dry condition for 16 hours. After release of the pressure, the two samples were separated from each other and the surface condition of the protective layer of the sample which was located at the lower part was visually observed. The blocking resistance of the thermosensitive recording medium was evaluated on the following scale:

◎: The surface of the protective layer was not changed after separated from the other sample, so that the blocking resistance of the thermosensitive recording medium was excellent.

○: The surface of the protective layer was slightly changed by the contact with the other sample, but this sample was acceptable for practical use.

x: The protective layer was partially peeled away, so that the blocking resistance of the thermosensitive recording medium was poor.

The results are also shown in TABLE 1.

TABLE 1

| | Thermal Sensitivity after Stored at 50° C. for 200 Hours | Decrease of Thermal Sensitivity after Storage | Blocking Resistance |
|---|---|---|---|
| Ex. 1 | 26 mj/mm$^2$ | 1 mj/mm$^2$ | ○ |
| Ex. 2 | 26 mj/mm$^2$ | 1 mj/mm$^2$ | ◎ |
| Comp. Ex. 1 | 28 mj/mm$^2$ | 5 mj/mm$^2$ | ◎ |
| Comp. Ex. 2 | 27 mj/mm$^2$ | 3 mj/mm$^2$ | x |

As can be seen from the results shown in TABLE 1, the thermal sensitivity of the thermosensitive recording media according to the present invention was sufficiently high and deterioration of the thermal sensitivity was minimized even after the recording media were stored at high temperature. This is because the thermosensitive recording layer comprises both the plasticizer and the liquid resin.

The amount ratio by weight of the mixture of the plasticizer and the liquid resin was 23.8 wt. % of the total weight of the thermosensitive recording layer in the recording medium prepared in Example 1; while it was 12 wt. % in the recording medium prepared in Example 2. Therefore, the blocking resistance of the thermosensitive recording medium prepared in Example 2 was superior to that of the recording medium prepared in Example 1.

Since neither plasticizer nor liquid resin was contained in the thermosensitive recording layer of the comparative recording medium No. 1, the thermal sensitivity was poor and considerably variable. In the comparative recording medium No. 2, only the plasticizer was contained in the thermosensitive recording layer. Therefore, the thermal sensitivity was poor and variable, and the blocking resistance was very poor.

Japanese Patent Application No. 09-159283 filed Jun. 3, 1997 and Japanese Patent Application filed Jun. 2, 1998 are hereby incorporated by reference.

What is claimed is:

1. A thermosensitive recording medium comprising a support, and thermosensitive recording layer formed thereon comprising:

an electron-donating coloring compound, an electron-accepting compound, a binder resin, a liquid resin which is in a liquid state at room temperature, and a plasticizer.

2. The thermosensitive recording medium as claimed in claim 1, wherein the total amount of said liquid resin and said plasticizer is in a range of 0.1 to 20 wt. % of the total weight of said thermosensitive recording layer.

3. The thermosensitive recording medium as claimed in claim 1, wherein the amount of said plasticizer is in a range of 0.1 to 95% wt. % of the total weight of said plasticizer and said liquid resin.

4. The thermosensitive recording medium as claimed in claim 1, wherein said thermosensitive recording layer further comprises a high-boiling solvent, oils and fats, and a surfactant.

5. The thermosensitive recording medium as claimed in claim 1, further comprising a protective layer which is overlaid on said thermosensitive recording layer.

6. The thermosensitive recording medium as claimed in claim 5, further comprising an antistatic layer which is provided on the back side of said support, opposite to said thermosensitive recording layer with respect to said support, and on said protective layer.

7. The thermosensitive recording medium as claimed in claim 6, wherein said antistatic layer comprises an electroconductive metallic oxide and a binder resin.

* * * * *